US005678145A

United States Patent [19]

Snelling et al.

[11] Patent Number: 5,678,145

[45] Date of Patent: Oct. 14, 1997

[54] XEROGRAPHIC CHARGING AND TRANSFER USING THE PYROELECTRIC EFFECT

[75] Inventors: Christopher Snelling, Penfield; Dale R. Mashtare, Macedon, both of N.Y.

[73] Assignee: Xerox Corporation, Stamford, Conn.

[21] Appl. No.: 669,117

[22] Filed: Jun. 24, 1996

[51] Int. Cl.[6] ..... G03G 15/02

[52] U.S. Cl. ..... 399/176; 347/114; 361/225

[58] Field of Search ..... 355/219; 361/225, 361/221; 347/233, 114; 430/902; 399/176

[56] References Cited

U.S. PATENT DOCUMENTS

| | | | |
|---|---|---|---|
| 4,067,056 | 1/1978 | Taylor et al. | 361/233 |
| 4,089,034 | 5/1978 | Taylor et al. | 361/233 |
| 5,153,615 | 10/1992 | Snelling | 347/114 |
| 5,185,619 | 2/1993 | Snelling | 347/114 |
| 5,353,105 | 10/1994 | Gundlach et al. | 347/114 X |
| 5,446,615 | 8/1995 | Matsumoto et al. | 361/225 |
| 5,561,502 | 10/1996 | Hirai et al. | 355/219 X |
| 5,604,569 | 2/1997 | Kubota | 399/232 |

*Primary Examiner*—Arthur T. Grimley
*Assistant Examiner*—Sophia S. Chen
*Attorney, Agent, or Firm*—William A. Henry, II

[57] ABSTRACT

Pyroelectric materials are used to create net charge/surface potentials for use in xerographic charge and transfer steps. Heating and cooling a pyroelectric film, such as, polyvinylidene fluoride induces thermal expansion or contraction which create surface charge density changes that can be used to charge a photoconductive surface and/or transfer an image from a photoconductive surface to a copy sheet.

10 Claims, 2 Drawing Sheets

XEROGRAPHIC CHARGING AND TRANSFER USING THE PYROELECTRIC EFFECT

BACKGROUND OF THE INVENTION

The present invention relates generally to apparatus for charging and/or transferring an image from a dielectric material, primarily for use in reproduction systems of the xerographic, or dry copying, type, and more particularly, utilizing the pyroelectric effect to achieve charging, and/or transfer in a xerographic system.

Generally, the process of electrostatographic copying is initiated by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface. Thereafter, the developing material is transferred from the photoreceptive member to a copy sheet or to some other image support substrate, to create an image which may be permanently affixed to the image support substrate, thereby providing an electrophotographic reproduction of the original document. In a final step in the process, the photoconductive surface of the photoreceptive member is cleaned to remove any residual developing material which may be remaining on the surface thereof in preparation for successive imaging cycles.

The electrostatographic copying process described hereinabove is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images.

PRIOR ART

Heretofore, polyvinylidene fluoride (PVDF) film and other materials have been known to exhibit pyroelectric effects. For example, it is known that the PVDF films may be heated to induce the formation of an electrostatic charge on the surface of the film. In addition, polarization of the film, where the majority of the dipole moments are permanently aligned, increases the magnitude of the pyroelectric behavior for the film. Alternatively, other materials, such as, triglycine sulfate (TGS) may be used to produce the electrostatic charge in response to a change in temperature, as described by Crowley in "Fundamentals of Applied Electrostatics" (Wiley & Sons, New York, 1986, pp. 137–145).

For example, U.S. Pat. No. 5,185,619 discloses a printer that includes the use of pyroelectric imaging members to produce prints. And Bergman et al. in U.S. Pat. No. 3,824,098 teaches an electrostatic copying device having a polymeric polyvinylidene fluoride film as a medium for producing a patterned electrostatic charge.

As discussed above, in electrostatographic reproductive devices it is necessary to charge a suitable photoconductive or reproductive surface with a charging potential prior to the formation thereon on the light image. Various means have been proposed for the application of the electrostatic charge to a photoconductive insulating body. One method of operation, for charging the photoconductive insulating body is a form of corona discharge wherein an adjacent electrode comprising one or more fine conductive bodies maintained at a high electric potential cause deposition of an electric charge on the adjacent surface of the photoconductive body. Examples of such corona discharge devices are described in U.S. Pat. No. 2,836,725 and U.S. Pat. No. 2,922,883. In practice, one corotron (corona discharge device) may be used to charge the photoconductor before exposure and another corotron used to charge the copy sheet during the toner transfer step. Corotrons are cheap, stable units, but they are sensitive to changes in humidity and the dielectric thickness of the insulator being charged. Thus, the surface charge density produced by these devices may not always be constant or uniform.

As an alternative to the corotron charging systems, roller charging systems have been developed. Such systems are exemplified by U.S. Pat. No. 2,912,586, U.S. Pat. No. 3,043,684, U.S. Pat. No. 3,398,336, U.S. Pat. No. 3,684,364 and U.S. Pat. No. 3,702,482. These devices are concerned with contact charging, that is the charging roller is placed in contact with the surface to be charged, e.g. the photoreceptor or final support (paper) sheet.

Surface contact charging rollers of the above-mentioned prior art type are restricted to a speed of rotation which is controlled by the speed of movement of the surface to be charged. In other words, because the charging roller contacts the support member, whether it be the photoconductor drum or belt or a paper sheet to which toner is to be transferred, the surface velocity of the charging roller must be equal to the velocity of the chargeable support member. U.S. Pat. No. 3,395,517 discloses the general relationship between energy stream intensity and imaging surface velocity required to achieve uniform charging of the imaging surface. In that patent, the charging roller is spaced from the imaging surface and does not have to be synchronized with the movement of the imaging surface.

Moreover, in all of these prior art devices the roller materials must, in general, be tailored to the particular application and the amount of charge placed on the chargeable support is usually only controlled as a function of the voltage applied to the charging roller. The prevention of pre-nip breakdown is achieved by appropriate selection of roll electrical properties. Dielectric relaxation times of charging and transfer rollers structures are defined according to the specific process speed. In addition to requiring changes in charging rollers structures for different operating speeds, the relaxation times of charging rollers must be maintained with an acceptable range. Degradation due to changes in conductivity by roll contamination of roll material changes represents, therefore, a potential failure mode of charging rollers.

The operation of transferring developing material from the photoreceptive member to the image support substrate is realized at a transfer station. In a conventional transfer station, transfer is achieved by applying electrostatic force fields in a transfer region sufficient to overcome forces holding the toner particles to the surface of the photoreceptive member. These electrostatic force fields operate to attract and transfer the toner particles over to the copy sheet or other image support substrate. Typically, transfer of toner images between support surfaces is accomplished via electrostatic attraction using a corona generating device. In such corona induced transfer systems, the surface of the image support substrate is placed in direct contact with the toner image while the image is supported on the photoreceptive member. Transfer is induced by "spraying" the back of the support substrate with a corona discharge having a polarity opposite that of the toner particles, thereby electrostatically attracting the toner particles to the sheet. An exemplary ion emission transfer system is disclosed in U.S. Pat. No. 2,836,725.

Toner transfer has also been accomplished successfully via based roll transfer systems. This type of transfer apparatus was first described by Fitch in U.S. Pat. No. 2,807,233, which disclosed the use of a metal roll coated with a resilient coating having an approximate resistivity of at least $10^6$ ohm-cm, that provides means for controlling the magnetic and non-magnetic forces acting on the toner particles during the transfer process. Bias roll transfer has become the transfer method of choice in many state-of-the-art xerographic copying systems and apparatus, as can be found, for example, in the Model 9000 Series of machines manufactured by Xerox Corporation. Notable examples of bias roll transfer systems are described in U.S. Pat. No. 3,702,482 by C. Dolcimacsolo et al, and U.S. Pat. No. 3,782,205, issued to T. Meagher.

The critical aspect of the transfer process focuses on maintaining the same pattern and intensity of electrostatic fields as on the original latent electrostatic image being reproduced to induce transfer without causing scattering or smearing of the developer material. This essential and difficult criterion is satisfied by careful control of the electrostatic fields, which, by necessity, must be high enough to effect toner transfer while being low enough so as not to cause arcing or excessive ionization at undesired locations. Such electrical disturbances can create copy or print defects by inhibiting toner transfer or by inducing uncontrolled transfer which can easily cause scattering or smearing of the development materials.

Hereinbefore, transfer and charging systems have required sources of high voltage at low current levels for maintaining the same pattern and intensity of electrostatic fields as on the original latent electrostatic image being reproduced to induce transfer. This requirement has been usually met by incorporating high voltage power supplies for feeding the coronas and bias rolls which perform such processes as precharge, development and transfer. These high voltage power supplies have added to the overall cost and weight of electrophotographic printers.

A simple, relatively inexpensive, and accurate approach to eliminate the expense and weight of traditional high voltage sources in such printing systems has been a goal in the design, manufacture and use of electrophotographic printers. The need to provide accurate and inexpensive transfer and charging systems has become more acute, as the demand for high quality, relatively inexpensive electrophotographic printers has increased. This requirement has been usually met by incorporating high voltage power supplies. These high voltage power supplies have added to the overall cost and weight of electrophotographic printers.

SUMMARY OF THE INVENTION

Accordingly, disclosed herein is a method and apparatus that enables charging and transfer steps in xerographic systems by using pyroelectric materials to create net charge/surface potentials. Heating and cooling a pyroelectric film, such as PVDF, induces thermal expansion or contraction which creates surface charge density changes which are used to provide required charging of the photoconductive member before exposure of the photoconductive member in imagewise configuration takes place, as well as, provide electrical charge as required for transfer of an image from the photoconductive member to a copy sheet.

BRIEF DESCRIPTION OF THE DRAWINGS

The foregoing and other features of the instant invention will be apparent from a further reading of the specification, claims and from the drawings in which:

All references cited in this specification, and their references, are incorporated by reference herein where appropriate for teaching additional or alternative details, features, and/or technical background.

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the pyroelectric charging and transfer subsystems of the present invention preferably for use in a conventional copier/printer. However, it should be understood that the pyroelectric charging and transfer devices of the present invention could be used with any machine that requires charging a dielectric material and transferring an image from that dielectric material to a piece of support material.

Figure 2:
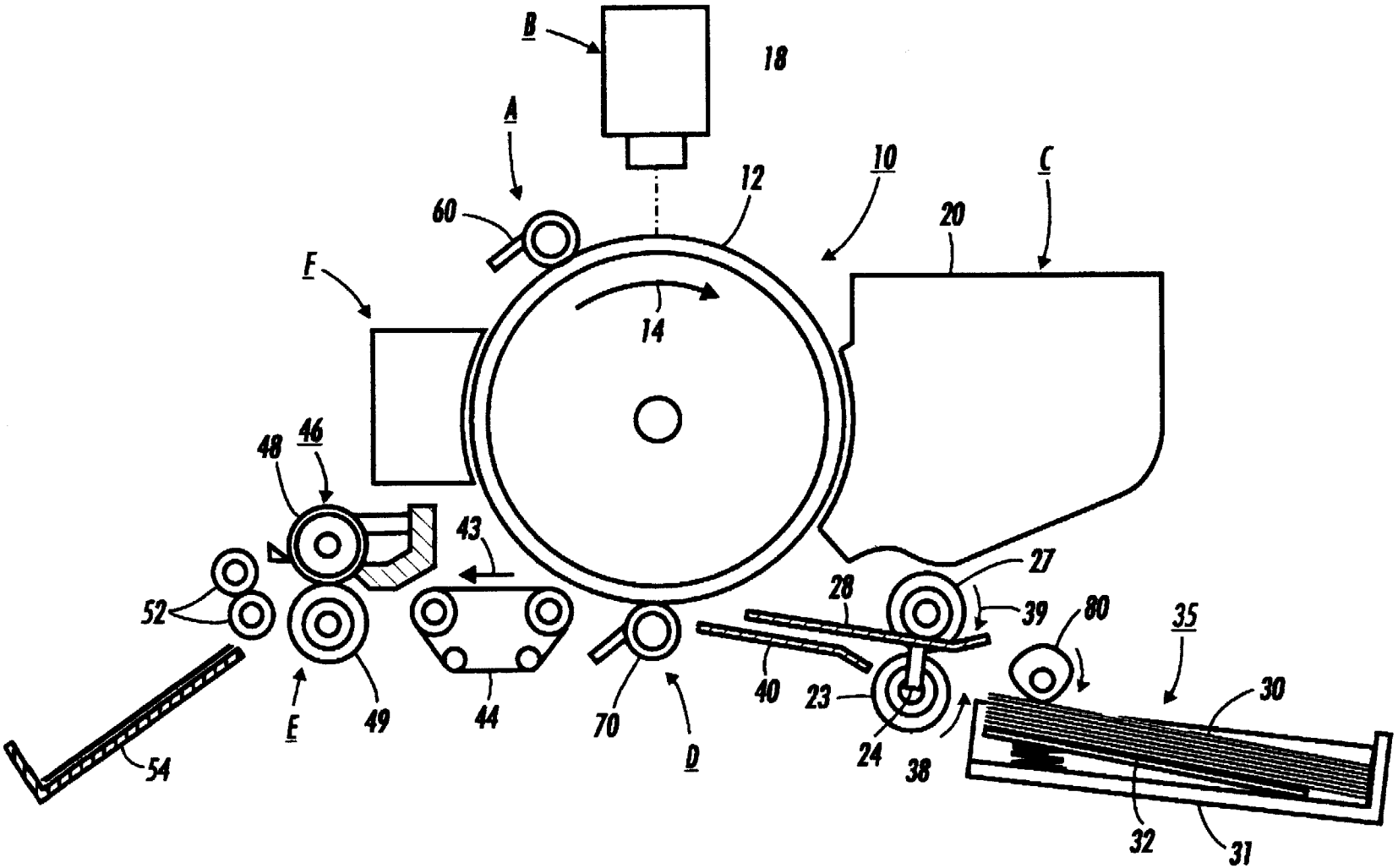
FIG. 2 illustrates an exemplary xerographic system incorporating charging and transfer subsystems in accordance with the present invention.

For a general understanding of the features of the present invention, reference is made of the drawings. In the drawings like reference numbers have been used throughout to designate identical elements. FIG. 2 schematically depicts the various subsystem components of an illustrative electrophotographic machine incorporating the charging and transfer apparatuses of the present invention therein.

As in all electrophotographic machines of the type illustrated, a drum 10 having a photoconductive surface 12 coated securely onto the exterior circumferential surface of a conductive substrate is rotated in the direction of arrow 14 through various processing stations. By way of example, photoconductive surface 12 may be made from selenium mounted on a suitable conductive substrate made from aluminum.

Initially, drum 10 rotates a portion of photoconductive surface 12 through charging station A. Charging station A employs a charging device in accordance with the present invention, indicated generally by the reference numeral 60, to charge photoconductive surface 12 to a relatively high substantially uniform potential.

Thereafter drum 10 rotates the charged portion of photoconductive surface 12 to exposure station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the information areas contained within the original document.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat fusible plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attached electrostatically from the carrier granules to the latent image forming a toner powder image on photoconductive surface 12.

With continued reference to FIG. 2, a copy sheet is advanced by sheet feeding apparatus 35 to transfer apparatus 70 at transfer station D. Sheet feed roll 80 advances successive copy sheets from platform 32 of copy sheet tray 31 to forwarding registration rollers 23 and 27. Forwarding registration roller 23 is driven conventionally by a motor (not shown) in the direction of arrow 38 thereby also rotating idler roller 27 which is in contact therewith in the direction of arrow 39. In operation, feed device 35 operates to advance the uppermost substrate or sheet from stack 30 into registration rollers 23 and 27 and against registration fingers 24. Fingers 24 are actuated by conventional means in timed relation to an image on drum 12 such that the sheet resting against the fingers is forwarded toward the drum in synchronism with the image on the drum. A conventional registration finger control system is shown in U.S. Pat. No. 3,902,715 which is incorporated herein by reference to the extent necessary to practice this invention. After the sheet is released by finger 24, it is advanced through a chute formed by guides 28 and 40 to transfer station D.

Continuing now with the various processing stations, transfer station D, in accordance with the present invention, includes a charging device which is the same as charging device 60 and applies a charge to the back side of the copy sheet. This attracts the toner powder image from photoconductive surface 12 to the copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by conventional rollers 52 to catch tray 54.

After the copy sheet is separated from photoconductive surface 12, some residual toner particles remain adhering thereto. Those toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

Figure 1:
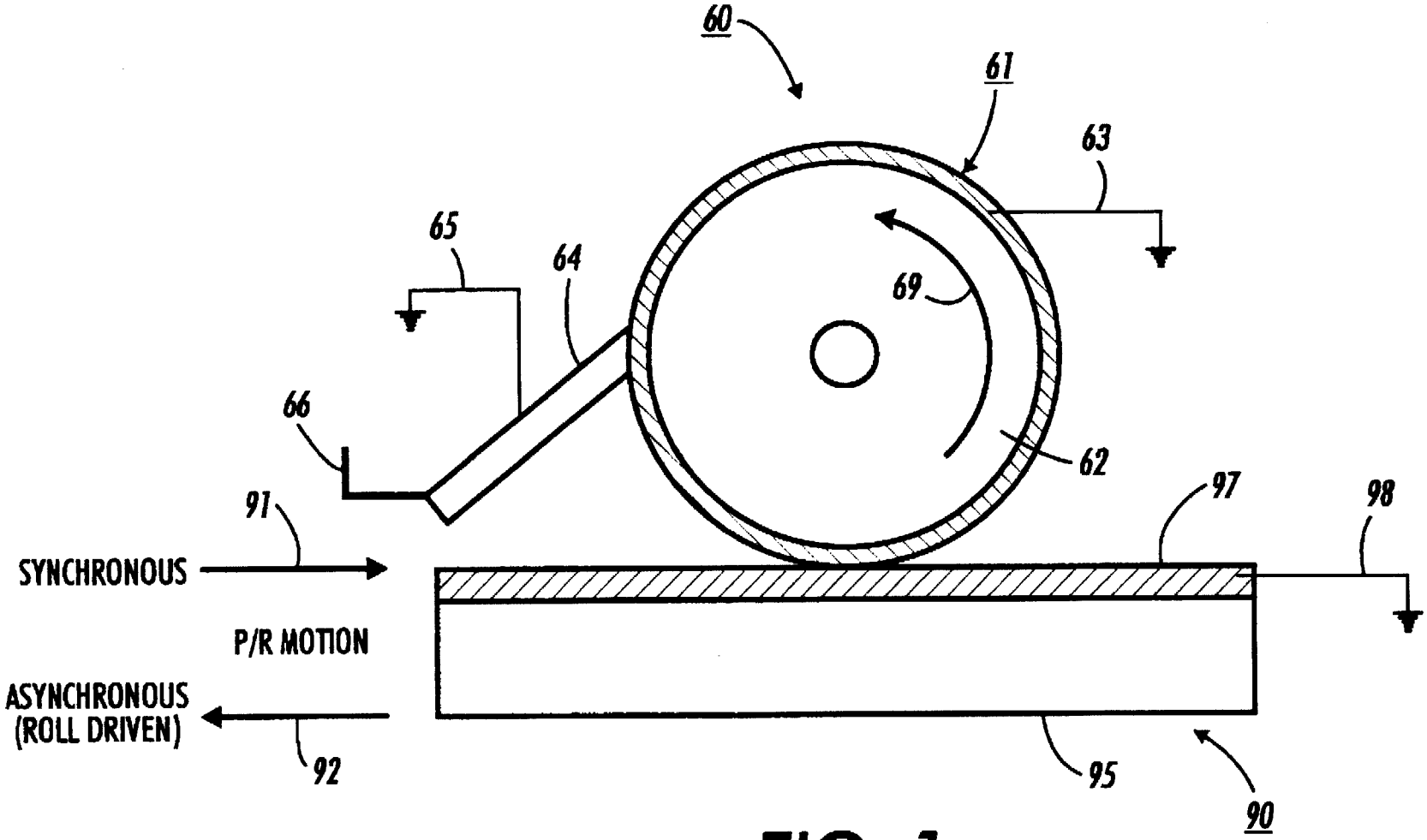
FIG. 1 illustrates the charging subsystems of the present invention.

Referring now to the subject matter of the present invention, FIG. 1 depicts the pyrotron charge apparatus 60 applied to a xerographic photoreceptor charging process. As mentioned heretofore, pyrotron transfer apparatus 70 is the same as charge apparatus 60. The charge apparatus 60 and the transfer apparatus 70 enable the performance of xerographic charging and transfer process steps without the need for high voltage supplies and are an attractive means to reduce system cost and size. In addition elimination or reduction of the emissions which result from using devices based upon corona discharge is desirable to reduce the environmental impact of xerographic systems. These desirable results and advantages over corona charging and transfer subsystems are obtained through generation of functional net charge/surface. potentials for xerographic charging and transfer steps from thermal energy input to flexible piezo active PVDF material due to its pyroelectric effect properties.

FIG. 1 illustrates one configuration of a pyrotron soft roll charge apparatus 60 applied to a xerographic photoreceptor charging process. The word pyrotron is used herein to mean a xerographic charging device based upon utilization of the pyroelectric effect. Charge apparatus 60, as shown, is based upon the pyrotron concept of utilizing heat energy to create net charge/surface potentials and includes pyroelectric material (PVDF) 61 layered onto a conductive roll 62 that is grounded at 63. Roll 62 is rotated in the direction of arrow 69 and is in light contact with photoreceptor 90 that is moved in synchronous motion with pyroelectric material 61 in the direction of arrow 91. Roll 62 can also be driven, asynchronously, if desired, in the direction of arrow 92 with respect to photoreceptor 90. Asynchronous motion between photoreceptor 90 and the charged surface of PVDF material 61 has been shown to improve charging uniformity. For the transfer process, however, synchronous motion between the PVDF and interposed paper is sufficient and simplifies the subsystem by eliminating the need to separately drive the roll. Photoreceptor 90 comprises a conductive substrate 95 with a dielectric material 97 mounted thereon. Photoreceptor 90 is grounded at 98.

A heated conductive cleaning and neutralizing blade 64 is grounded at 65 and supplies energy to charge the PVDF material 61 through contact therewith. Ideally, the source of the heat energy used to charge the pyrotron PVDF layer 61 would be scavenged from the toner heat fusing system. Alternatively, resistive heating elements could be used. In the FIG. 1 subsystem, for example, resistive elements (not shown) have been screen printed onto the top surface of blade 64. It is essential, however, that the temperature of the PVDF material does not exceed 80° C. to prevent depoling. This maximum temperature being dictated by the particular pyroelectic material used. Catch tray 66 is intended to contain residue materials cleaned off of PVDF layer 61 by the blade 64.

By way of testing, the xerographic transfer process step has been achieved with a 110μ thick film of poled PVDF wrapped onto a ½" diameter copper tube support and rolled against a grounded conductive rubber layer heated to 150° F. (66° C.). Surface potential of the subsequently cooled PVDF was measured by an ESV to be approximately 900 v, in good agreement with the value anticipated by the published PVDF pyroelectric constant value of 2.3 nc/cm$^2$/°C. Toner transfer was accomplished by rolling the charged film on paper placed on a toner developed image on stencil charged 1 mil Mylar.

An estimate of the thermal energy required to charge pyrotron device 60 may be deduced from modeling of the pyrotron device. Analysis suggests a heat energy input requirement for the pyrotron charging device 60 of FIG. 1 is on the order of 0.5 W/Cm at a process speed of 2.5 cm/sec (i.e., 12 watts for 1 ips/10" process width).

It should now be understood that a pyrotron device has been disclosed that is usable as a device to charge a photoconductive surface and/or as a device to transfer images from a photoconductive surface to a copy sheet without the need for a high voltage power supply. The pyrotron device achieves the electric fields/surface potentials required for charging and/or transfer by direct conversion of thermal energy through the pyroelectric effect in appropriately poled PVDF materials, for example.

While the invention has been described with reference to the structure herein disclosed, it is not confined to the details as set forth and is intended to cover any modifications and changes that may come within the scope of the following claims.

What is claimed is:

1. A pyroelectric charging device for charging a grounded photoconductive surface member, comprising:

a cylindrical conductive roll support structure;

a layer of pyroelectric film completely covering said cylindrical conductive roll, said conductive roll being adapted to be placed in contacting relation with the photoconductive surface; and a heater in communication with said pyroelectric film for heating said pyroelectric film to produce surface potentials that charge the photoconductive surface.

2. The pyroelectric device of claim 1, wherein said heater comprises a blade with resistive heating elements.

3. The pyroelectric device of claim 2, wherein said blade is adapted to clean and neutralize said layer of pyroelectric film.

4. The pyroelectric device of claim 1, wherein said layer of pyroelectric film includes polyvinylidene fluoride.

5. The printing apparatus of claim 1, wherein said heater comprises a blade with resistive heating elements.

6. The printing apparatus of claim 5, wherein said blade is adapted to clean and neutralize said layer of pyroelectric film.

7. A pyroelectric charging device, comprising:

a cylindrical conductive roll support structure;

a layer of pyroelectric film entirely surrounding said .cylindrical conductive roll adapted to be placed in contacting relation with a surface;

a heater in communication with said pyroelectric film for heating said pyroelectric film to produce surface potentials on said pyroelectric film that charge the surface.

8. A printing apparatus, comprising:

a photoconductive surface;

a charging device adapted to be placed in contact with said photoconductive surface for charging said photoconductive surface, said charging device including a conductive roll, a pyroelectric film surrounding said conductive roll, and a heater in communication with said pyroelectric film for heating said pyroelectric film to produce surface potentials that charge said photoconductive surface;

an imaging device for discharging said photoconductive surface in imagewise configuration;

a developing device for developing said imagewise configuration on said photoconductive surface;

a transfer device for transferring said imagewise configuration from said photoconductive surface to a copy sheet;

a fuser for fusing said imagewise configuration to the copy sheet; and an output device for receiving the copy sheet from said fuser.

9. The printing apparatus of claim 8, wherein said transfer device comprises a conductive roll, a pyroelectric film surrounding said conductive roll, and a heater in communication with said pyroelectric film for heating said pyroelectric film to produce surface potentials that charge said photoconductive surface.

10. The printing apparatus of claim 8, wherein said layer of pyroelectric film includes polyvinylidene fluoride.

* * * * *